US006035167A

United States Patent [19]

Sekura

[11] Patent Number: 6,035,167

[45] Date of Patent: Mar. 7, 2000

[54] WET-TYPE IMAGE FORMING APPARATUS AND SQUEEZING METHOD

[75] Inventor: Yuuki Sekura, Niigata, Japan

[73] Assignee: NEC Corporation, Japan

[21] Appl. No.: 09/346,148

[22] Filed: Jul. 9, 1999

[30] Foreign Application Priority Data

Jul. 10, 1998 [JP] Japan ..... 10-210298

[51] Int. Cl.[7] ..... G03G 15/10; G03G 21/00

[52] U.S. Cl. ..... 399/249; 399/345; 399/348

[58] Field of Search ..... 399/249, 237, 399/348, 345; 430/117

[56] References Cited

U.S. PATENT DOCUMENTS

| | | | |
|---|---|---|---|
| 5,521,685 | 5/1996 | Barnes et al. | 399/249 |
| 5,805,963 | 9/1998 | Teschendorf et al. | 399/249 |
| 5,913,096 | 6/1999 | Park | 399/237 X |
| 5,915,153 | 6/1999 | Kim et al. | 399/249 |

FOREIGN PATENT DOCUMENTS

| | | |
|---|---|---|
| 4-350878 | 12/1992 | Japan . |
| 8-160791 | 6/1996 | Japan . |

*Primary Examiner*—Susan S.Y. Lee

*Attorney, Agent, or Firm*—Ostrolenk, Faber, Gerb & Soffen, LLP

[57] ABSTRACT

A wet-type image forming apparatus providing a uniform pressure applied to a photoconductor belt is disclosed. A squeezing roller is provided in the development side of the photoconductor belt and a backup roller in provided in the non-development side of the photoconductor belt. The photoconductor belt is held by the squeezing and backup rollers under a predetermined pressure during development. The squeezing roller is moved toward or away from the photoconductor belt and the longitudinal axis of the backup roller is titled to a predetermined angel with respect to that of the squeezing roller about an longitudinal middle point thereof during the development.

12 Claims, 8 Drawing Sheets

WET-TYPE IMAGE FORMING APPARATUS AND SQUEEZING METHOD

BACKGROUND OF THE INVENTION

1. Field of the Invention

The present invention relates to a wet-type image forming apparatus using electrophotographic technique and in particular to a squeezing technique for removing excess liquid developer from a photoconductor belt.

2. Description of the Related Art

In general, a wet-type image forming apparatus is composed of a squeezing roller arranged on the developed side of a photoconductor member and a backup roller arranged on the undeveloped side of the photoconductor member. The squeezing roller is used to remove excess liquid developer from the surface of the photoconductor member at the time of development of a latent image formed on the photoconductor member. The backup roller holds the photoconductor member with the squeezing roller under a predetermined pressure at the time of development so that the liquid developer remaining on the photoconductor member at the time of development is removed while at the same time reducing the thickness of toner on the photoconductor member.

After development, the force with which the photoconductor member is held by the squeezing roller and the backup roller is reduced to remove the liquid developer remaining between the squeezing roller and the photoconductor member (this operation is called "reverse squeezing"). In other words, upon complete development, the squeezing roller is driver in reverse rotational direction while kept in contact with the photoconductor belt 7 and a blade comes into contact with the squeezing roller to remove the residual ink.

An conventional apparatus for removing excess liquid developer on a photoconductor member has been disclosed in Japanese Unexamined Patent Publication No. 4-350878. This apparatus includes a means for detecting the rotational position of the photoconductor member and the squeezing roller, a means for calculating the gap under squeezing from the relation between the rotational position and the corresponding amount of eccentricity which are measure din advance, and a means for controlling the gap setting position of the squeezing roller to assure a constant gap with respect to the rotational position. The apparatus maintains a uniform gap between the photoconductor member and the squeezing roller and prevents the fluctuation of thickness of the toner layer on the surface of the photoconductor member.

A fixing unit including a heating roller and a pressure roller in contact with each other under a contact pressure appropriately controlled had been disclosed in Japanese Unexamined Patent Publication No. 8-160791. In the fixing unit, a transfer member such as a paper carrying an unfixed toner image thereon is passed through an area held between the heating roller and the pressure roller, so that the unfixed toner image is fixed by fusion on the transfer member with heat and pressure. The pressure between the rollers is controlled to change in accordance with the properly and thickness of the transfer member.

In the case where rollers are arranged parallel to the axes thereof, the shortage of the holding force develops in the central portion thereof, thereby leading to such inconveniences as an insufficient fixing and a conveyance failure at the central portion. A technique known to obviate the shortage of the holding force at the central portion consists in arranging the roller pair in a position with the axes thereof crossing each other. An excessively large crossing angle, however, undesirably causes the difference in the conveyance direction to develop a wrinkle of a thin transfer member. The cited patent publication discloses an apparatus for obviating this inconvenience. A cylindrical thin heating roller and a pressure roller are provided such that the heating roller is in contact with the pressure roller with crossing at a predetermined angle to a longitudinal direction. The crossing angle is adapted to be changed in accordance with the pressure of the pressure roller.

In the conventional wet-type image forming apparatus, as disclosed in Japanese Unexamined Patent Publication No. 4-350878, a squeezing roller and a backup roller are normally arranged with the axes thereof parallel to each other. In the case where a pressure is applied to the ends of the squeezing roller for exerting a large force (say, 6 kg to 12 kg) to hold the squeezing roller and the backup roller, the squeezing pressure exerted by the squeezing roller is larger at the axial ends thereof and smaller at the central portion along the axis thereof. This lack of uniformity of pressure leads to a problem of variations of the image drying rate, thereby causing a nonuniform transfer efficiency to the paper.

In the case where the pressure on the backup roller is increased for correcting the imbalance of the squeezing pressure, the squeezing roller is prevented from being smoothly driven so that the image is liable to be scraped off.

A method for securing a uniform squeezing pressure at the time of development by crowing or tapering the backup roller, on the other hand, has a disadvantage that the squeeze pressure is liable to develop an imbalance at the time of reverse squeeze.

SUMMARY OF THE INVENTION

An object of the present invention, which has been developed in view of the problems of the prior art described above, is to provide a wet-type image forming apparatus in which the lack of uniformity of the pressure applied to the photoconductor belt is corrected while at the same time securing a uniform squeezing pressure.

Another object of the present invention is to provide a squeezing method which can produce a uniform pressure applied to the photoconductor belt.

According to an aspect of the present invention, a wet-type image forming apparatus includes: a photoconductor belt having a development side and a non-development side thereof; a first roller provided in the development side of the photoconductor belt, for removing an excess liquid developer from the development side of the photoconductor belt; a second roller provided in the non-development side of the photoconductor belt, for holding the photoconductor belt with the first roller under a predetermined pressure during development; a driving mechanism for moving the first roller toward and away from the photoconductor belt; and a tilting mechanism for tilting a longitudinal axis of the second roller to a predetermined angle with respect to a longitudinal axis of the first roller about an longitudinal middle point thereof during the development.

The tilting mechanism may set the longitudinal axis of the second roller in parallel to that of the first roller when a holding force produced by the first roller and the second roller is weakened by the driving mechanism. The tilting mechanism may include a pair of supporting members for rotatably and slidably supporting the second roller at ends thereof, the supporting members having a pair of cam slits formed therein, respectively, wherein the ends of the second roller are supported by the cam slits, respectively, and are moved in opposite horizontal directions in synchronism with movement of the first roller by the driving mechanism.

According to another aspect of the present invention, in a wet-type image forming apparatus having a squeezing roller provided in a development side of the photoconductor belt and a backup roller provided in a non development side of the photoconductor belt, for holding the photoconductor belt win the squeezing roller under a predetermined pressure, during development, a) moving the squeezing roller toward the photoconductor belt to set a first stage; and b) tilting a longitudinal axis of the backup roller to a predetermined angle with respect to a longitudinal axis of the squeezing roller about an longitudinal middle point thereof.

Further, when the development has been completed, the squeezing roller may be moved away from the photoconductor belt by a predetermined distance to set a second stage where a holding force produced by the squeezing roller and the backup roller is reduced. And, the longitudinal axis of the backup roller may be set in parallel to that of the squeezing roller.

Furthermore, the squeezing roller is rotated in an opposite direction to movement of the photoconductor belt to remove an excess liquid developer from the surface of the photoconductor belt.

DESCRIPTION OF THE PREFERRED EMBODIMENT

Figure 1A:
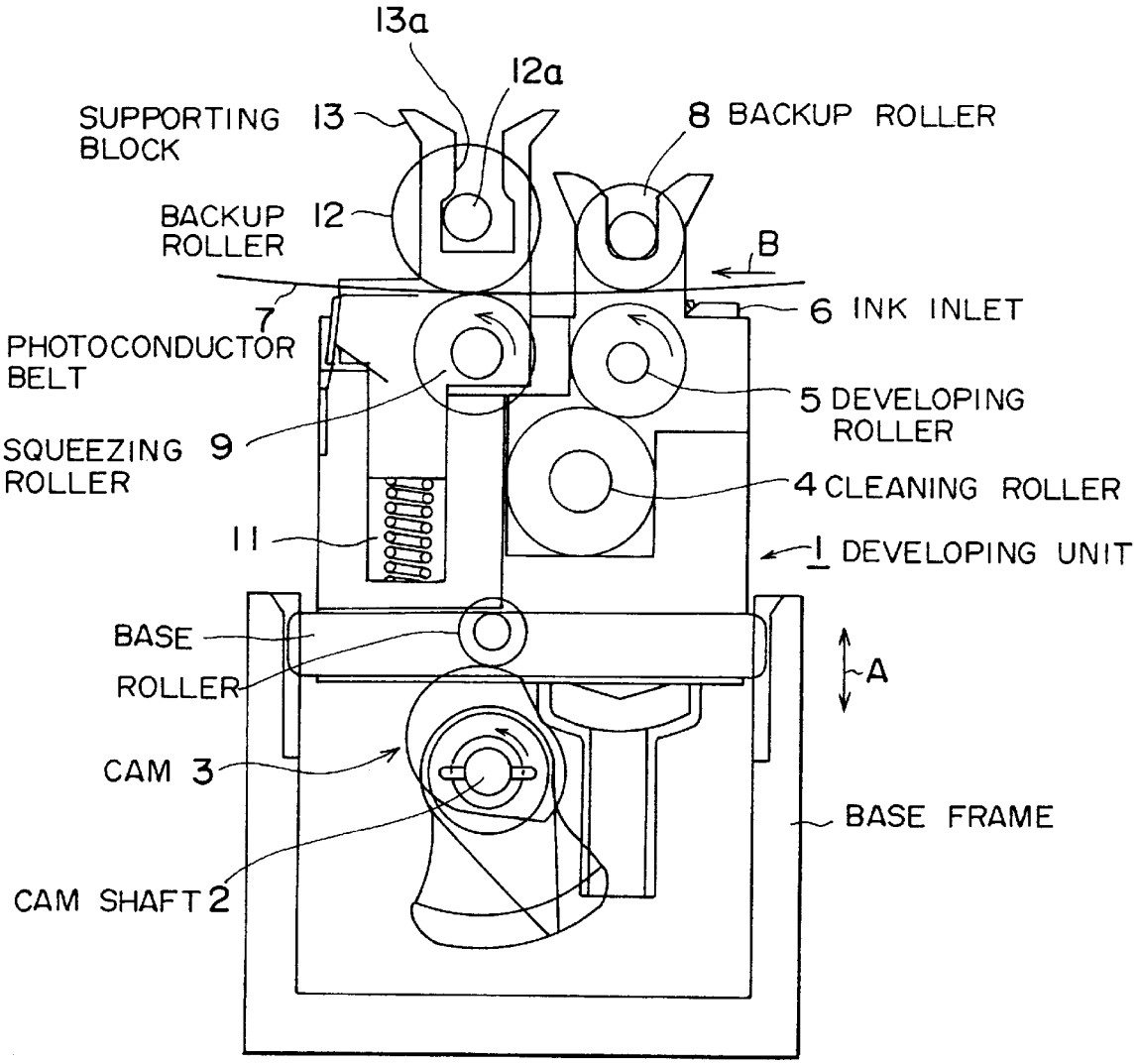
FIG. 1A is a side sectional view showing a structure of a developing unit according to an embodiment of the invention during development.
Figure 1B:
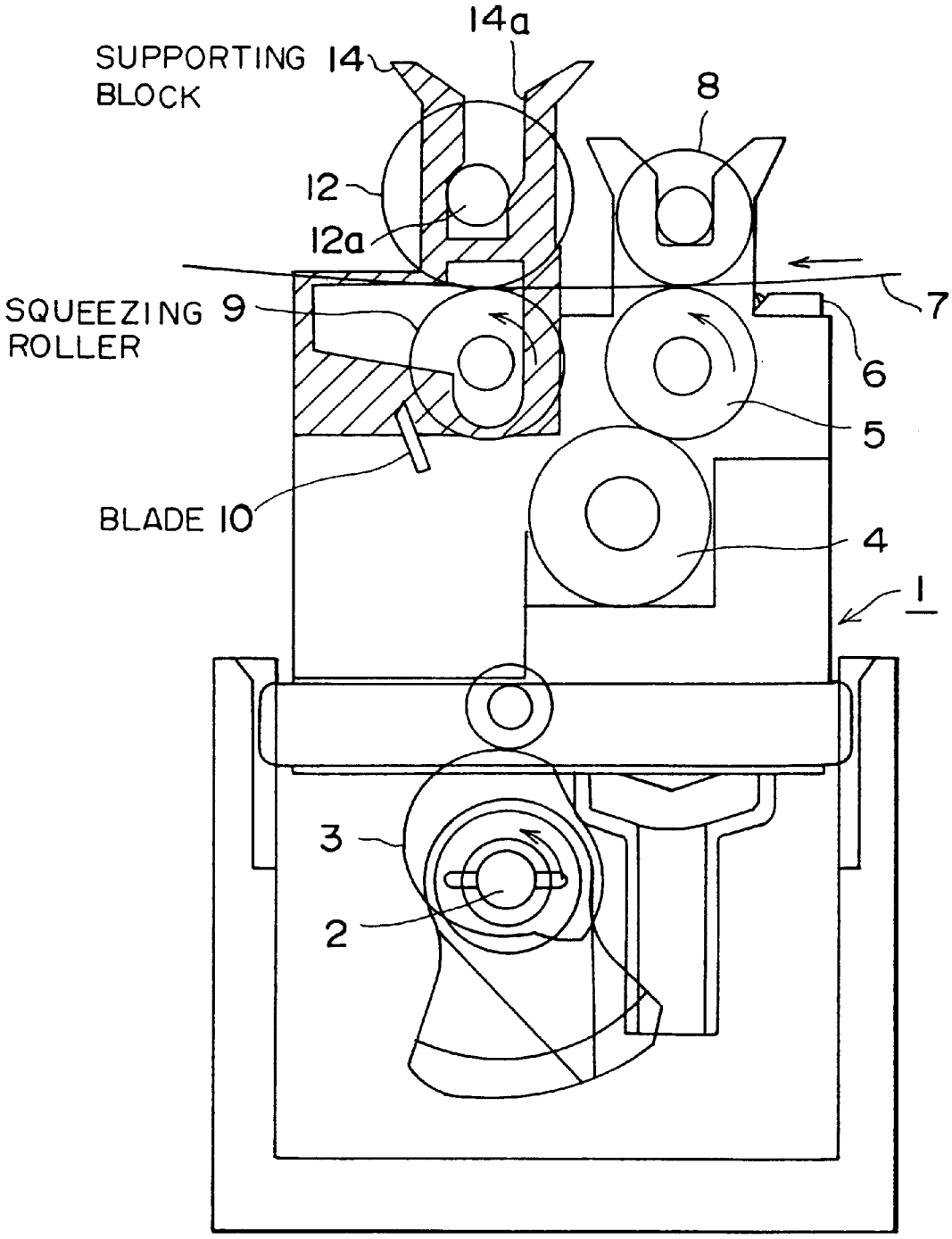
FIG. 1B is a side sectional view taken at a different position in FIG. 1A for depicting a supporting block 14.
Figure 7:
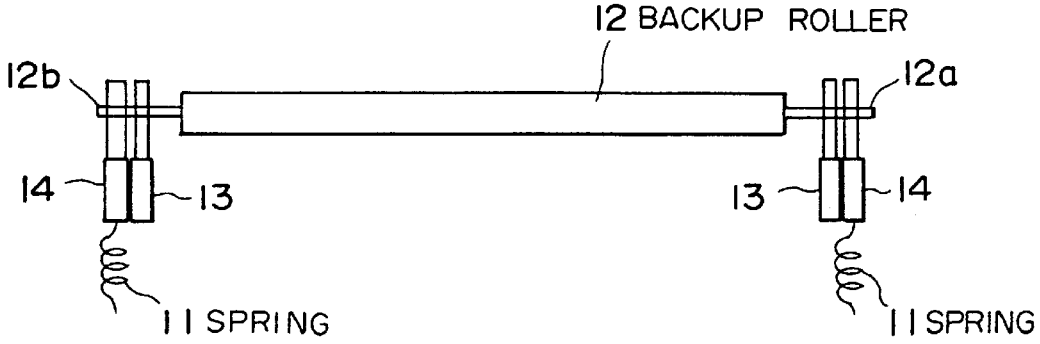
FIG. 7 is a schematic front view showing the support structure of the backup roller.

FIGS. 1A and 1B show a developing unit according to an embodiment of the invention at the time of development. The relative positions of supporting blocks 13 and supporting blocks 14 along the roller axis are shown in FIG. 7.

A developing unit 1 is placed on a driving mechanism which is composed of a camshaft 2 which has a cam 3 fixed thereto and is rotatably supported in a base frame, a motor (not shown) for rotating the camshaft 2, and a movable base which is supported on the cam 3 through a roller and movable vertically inside the base frame in a direction indicated by reference symbol A. As will be described later, the cam 3 causes the developing unit 1 to move in the direction A to provide three stages; upper, middle, and lower, corresponding to development, reverse squeezing, and stop operations, respectively.

Members involved in conveyance and development of the photoconductor belt 7 are arranged in a movable frame on the movable base. Specifically, a developing roller 5 is supported and faced to the outside surface of the photoconductor belt 7 at a position upstream along the direction B of conveyance. A cleaning roller 4 is arranged under the developing roller 5 in such a manner that the outer peripheral surfaces are in contact with each other.

A developing backup roller 8 is arranged as opposed to the developing roller 5 with intervention of the photoconductor belt 7. The developing backup roller 8 has the axial end thereof fitted and supported in a substantially U-shaped notch opened upward at the upper end of the movable frame extending above the point of passage of the photoconductor belt 7.

The essential parts involved in the conveyance of the photoconductor belt 7 or the squeezing operation are fixed or arranged on the movable base. Specifically, a supporting block 13 is fixed on each of the opposed edges of the movable base. A squeezing roller 9 is supported at a position under the point of passage of the photoconductor belt 7 between the two supporting blocks 13 (see FIG. 7). Also, the upper end of each supporting block 13 extending above the point of passage of the photoconductor belt 7 is formed with a substantially U-shaped notch in which the axial end (12*a*, 12*b*) of a squeezing backup roller 12 is loosely fitted. Specifically, the two side edge portions of the U shaped notch are sloped widening downward from the middle portion to form a wide bottom.

Two supporting blocks 14 supported on the movable base are arranged adjacently to the two supporting blocks 13 such that the supporting blocks 14 are energized by springs 11, respectively (see FIG. 1B and FIG. 7). The upper end portion of each supporting block 14 extending upward beyond the point of passage of the photoconductor belt 7 is formed with a bottomed slit, which as a predetermined width and substantially the central portion thereof diagonally deformed with a width equal to the diameter of the axial end of the squeezing backup roller 12 so that the axial end of the squeezing backup roller 12 may be fitted therein.

Figure 6:
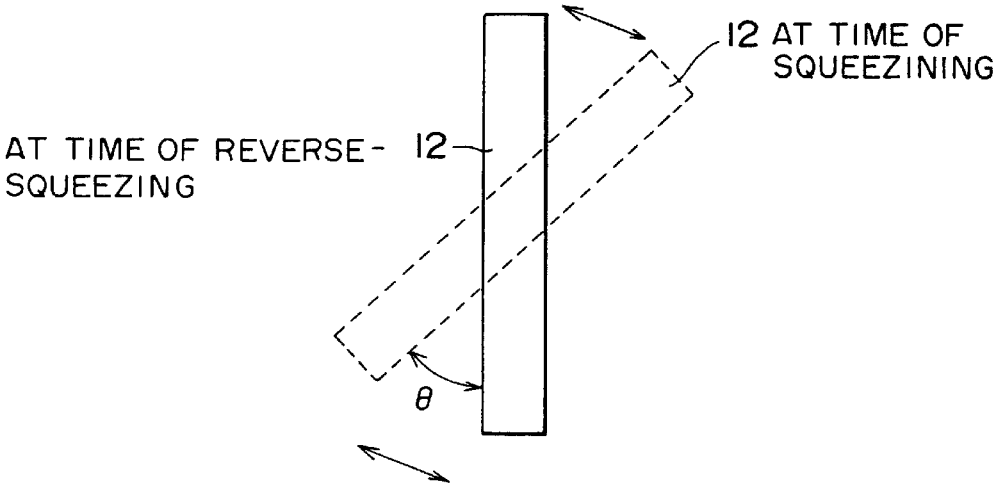
FIG. 6 is a schematic plan view for explaining the operation of tilting the backup roller.

More specifically, the respective slits at the ends of the two supporting blocks 14 have the same upper end portions thereof, but have the central portions (diagonal portions) thereof extending downward in opposite diagonal directions and connected to the lower portions thereof extending vertically downward. In other words, the respective supporting blocks 14 have cam slits 14*a* and 14*b* which are different in direction of slit curve. In response to the vertical movement of the supporting blocks 14, therefore, the squeezing backup roller 12 with the respective axial ends 12*a* and 12*b* thereof fitted in the right and left slits of the supporting blocks 14 rotates by a predetermined angle in horizontal direction while maintaining a horizontal roller shaft position (see FIG. 6 and FIG. 7). Therefore, when the axial ends 12*a* and 12*b* of the supporting blocks 14 are at the lower position of the right and left slits as shown in FIGS. 1A and 1B, the squeezing backup roller 12 crosses the axis of the squeezing roller 9 at a prescribed angle thereto. When the supporting blocks 14 are located at the upper position thereof, on the other hand, the squeezing backup roller 12 is located parallel to the axis of the squeezing roller 9.

Each of the component elements will be explained hereafter. The developing unit 1 is adapted to move vertically to specific positions including an upper stage (for development), a middle stage (for reverse squeezing) and a lower stage (for stoppage) by means of the cam 3 fixed to the camshaft 2 which is rotated by the motor (not shown). The motor, the camshaft 2 and the cam 3 make up a driving mechanism.

The developing roller 5 is made of a metal and is rotated in the direction indicated by an arrow for feeding a liquid developer supplied from the ink supply port 6 to the photoconductor belt 7. In the case where the developing unit 1 is located in the upper stage as shown in FIGS. 1A and 1B, a latent image formed on the photoconductor belt 7 is developed by toner of the liquid developer. A gap of 0.10 to 0.20 mm is formed between the developing roller 5 and the photoconductor belt 7 for development.

The cleaning roller 4 is shaped like a cylinder such that a foam material is mounted on the outer periphery of a hollow shaft having a plurality of holes in the surface of the side cylindrical portion thereof. The liquid developer (containing a positively charged toner and a solvent, which mixture will hereinafter be referred to as "ink"), which is supplied to the central hollow portion of the shaft and oozes out to the foam material, washes off the ink from the developing roller 5 in contact with the outer peripheral surface of the foamed material.

The photoconductor belt 7 is composed of a plastic film on which a photoconductor layer is deposited. By charging and exposing this photoconductor belt 7, a later image is formed and developed in the developing unit 1.

The developing backup roller 8 is on the other side of the photoconductor belt 7 with respect to the developing roller 5 and is in contact with the photoconductor belt 7 thereby to maintain a fixed gap between the developing roller 5 and the photoconductor belt 7.

The squeezing roller 9 and the squeezing backup roller 12 are provided downstream from the developing roller 5 and the developing backup roller 8. After development, the photoconductor belt 7 is further conveyed in the direction B to between the squeezing roller 9 and the squeezing backup roller 12. The squeeze backup roller 12 supports the photoconductor belt 7 to increase the contact pressure onto the squeezing roller 9 at the time of development and reverse squeezing.

Any material can be used for the surface of the squeezing roller 9 as far as at least a predetermined contact area can be secured when the surface of the squeezing roller 9 comes into contact with the photoconductor belt 7. A preferable surface material of the squeezing roller 9 is rubber (urethane rubber, etc.). The outer cylindrical surface of the squeezing roller 9 comes into contact with the photoconductor belt 7 and removes the excess solvent of the image portion developed by the developing roller 5 and the ink component remaining in the non-image portion. At the same time, this squeezing roller 9 functions to reduce the thickness of the developed toner image on the photoconductor belt 7.

After development, the developing unit 1 moves to the middle stage for reverse squeezing. The reverse squeezing operation causes the ink remaining between the photoconductor belt 7 and the squeezing roller 9 to be removed. Only during this reverse squeezing, the blade 10 comes into contact with the squeezing roller 9 to remove the residual ink.

The springs 11 have the function of pressing the squeezing roller 9 against the photoconductor belt 7 with an energizing force of 6 to 12 kg when the developing unit 1 is located at the upper stage and pressing it with an energizing force (load) of 1 to 2 kg in the middle stage.

The squeezing backup roller 12 is located on the other side of the photoconductor belt 7 as viewed from the squeezing roller 9, and in cooperation with the squeezing roller 9, exerts a predetermined pressure to the photoconductor belt 7 against the squeezing roller at the time of development and reverse squeezing.

The supporting blocks 14 are fixed on the developing unit 1 and vertically moves with the developing unit 1. The squeezing backup roller 12 is relocated by the cam slits 14*a* and 14*b* constituting a part of the tilting mechanism formed in the supporting blocks 14 and thus comes to cross the squeezing roller 9 at an angle when the developing unit 1 is in the upper stage (at the time of development) as shown in FIGS. 1A and 1B.

At the time of reverse squeezing, the squeezing backup roller 12 is returned to the position overlapped in parallel with the squeezing roller 9 by the cam slots 14*a* and 14*b* of the supporting blocks 14.

Now, an explanation will be given of the operation of a wet-type image forming apparatus according to this embodiment configured as described above.

DEVELOPMENT MODE

Referring to FIGS. 1A and 1B, the developing unit 1 is lifted to the upper stage by the cam 3 of the camshaft 2 rotated by the motor. The developing roller 5 rotates so that the ink supplied from the ink supply port 6 is conveyed to the photoconductor belt 7.

When the developing unit 1 is located in the upper stage, a gap of 0.10 to 0.20 mm is formed between the developing roller 5 and the photoconductor belt 7. The developing roller 5 is set to the potential of about 100 to 600 V, the developing area of the photoconductor belt 7 is set to the potential of about 100 V, and the non-developing area thereof is set to the potential of about 600 to 700 V. Based on these potential differences, the ink is selectively adhered thereby to develop a latent image formed on the photoconductor belt 7. As of this time point, the developed image is wetted by the solvent component.

During the printing operation, the photoconductor belt 7 moves from right to left in FIGS. 1A and 1B at constant speed, and the developed image moves to the position of the squeezing roller 9.

The squeezing roller 9 is driven in contact with the photoconductor belt 7 and thus removes the excess solvent component of the image portion and the ink component remaining in the non-image portion, while at the same time reducing the thickness of the developed toner image formed on the photoconductor belt 7.

At the time of development when the developing unit 1 is lifted, the squeeze backup roller 12 rotates in a horizontal direction to a position where a predetermined angel is maintained with the squeezing roller 9 by the cam slits 14*a* and 14*b* of the supporting blocks 14. As a result, the squeezing roller 9 and the squeeze backup roller 12 are fixed with the transverse central portions thereof overlapped and the photoconductor belt 7 held therebetween.

REVERSE SQUEEZING MODE

Figure 2A:
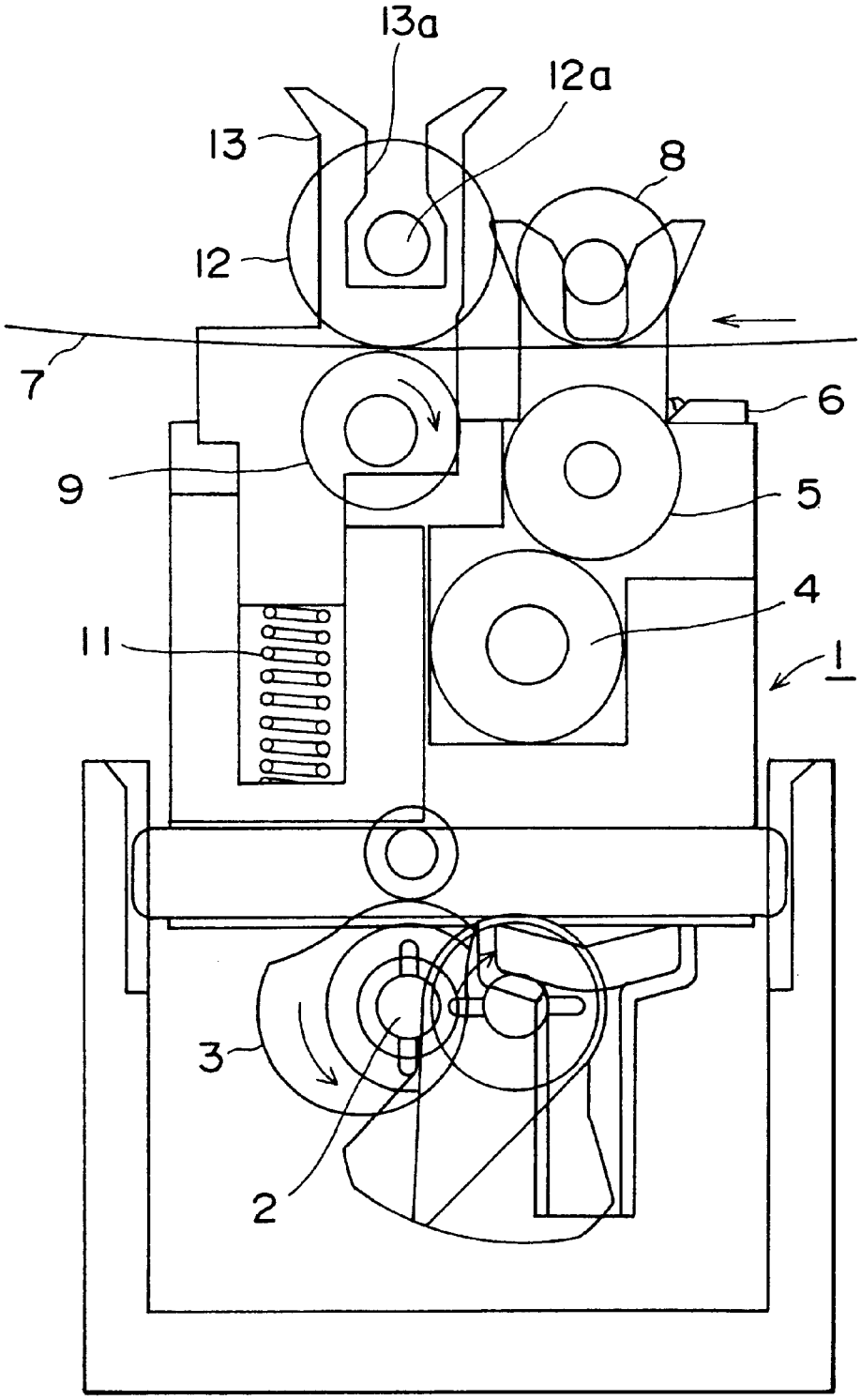
FIG. 2A is a longitudinal sectional view showing the developing unit according to the embodiment of the invention during reverse squeezing.
Figure 2B:
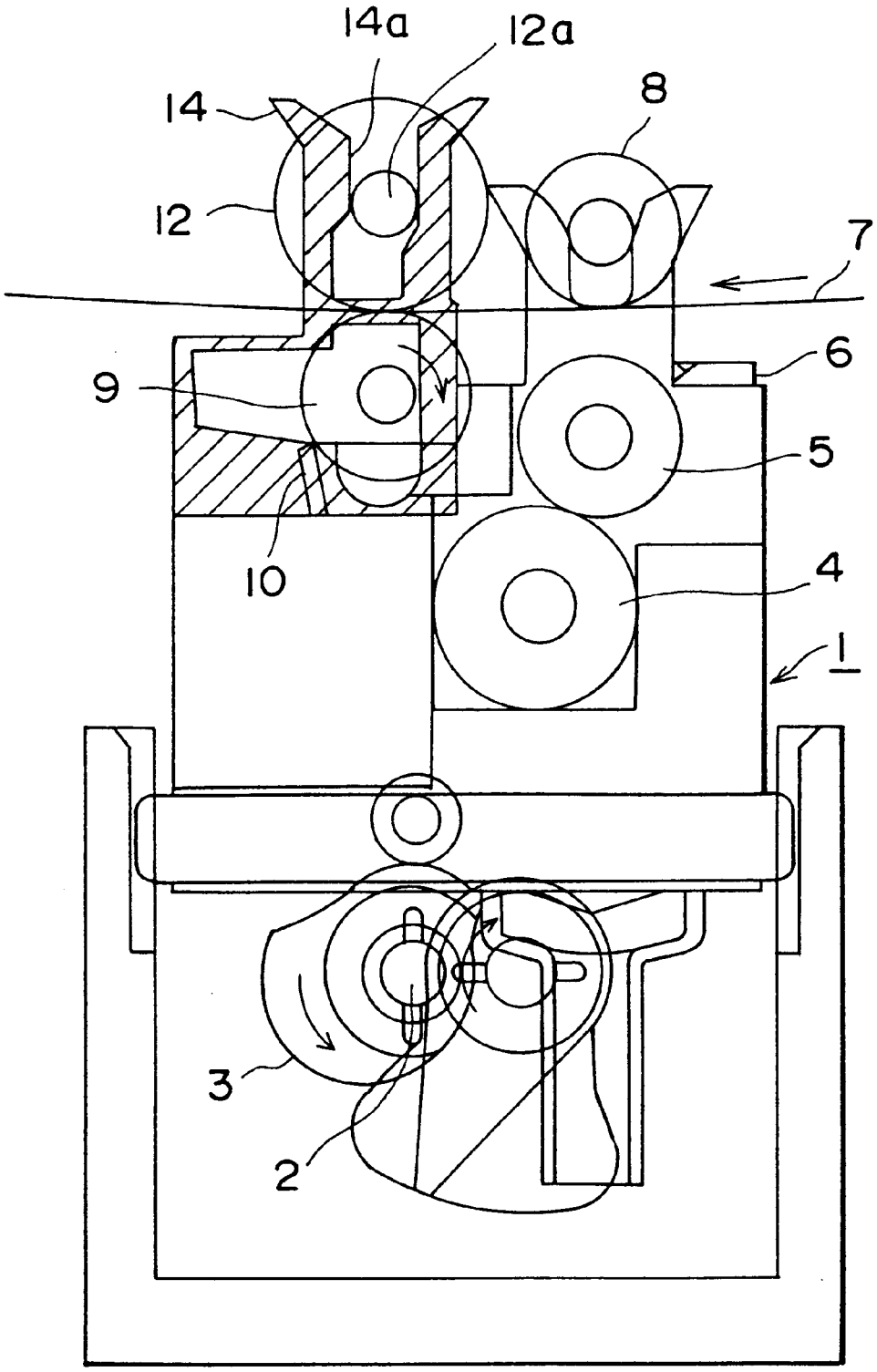
FIG. 2B is a longitudinal sectional view taken at a different position in FIG. 2A for depicting the supporting block 14.

As shown in FIGS. 2A and 2B, after complete development, the developing unit 1 is lowered to the middle stage position by the cam 3 of the camshaft 2 rotated by the motor. At the same time, the squeezing backup roller 12 is rotated to the position where it is overlapped with the squeezing roller 9 in axially parallel by the cam slits 14*a* of the supporting blocks 14. The photoconductor belt 7 continues to move from right to left in FIGS. 2A and 2B at constant speed until the non-image area of the photoconductor belt 7 reaches the position of the squeezing roller 9.

The squeezing roller 9 is driven in reverse rotational direction in contact with the photoconductor belt 7. At the same time, the squeezing backup roller 12 is rotated to the position where it is overlapped with the squeezing roller 9 in axially parallel. The blade 10 comes into contact with the squeezing roller 9 only at the time of reverse squeezing after development to remove the ink remaining.

COMPLETION OF DEVELOPMENT

Figure 3:
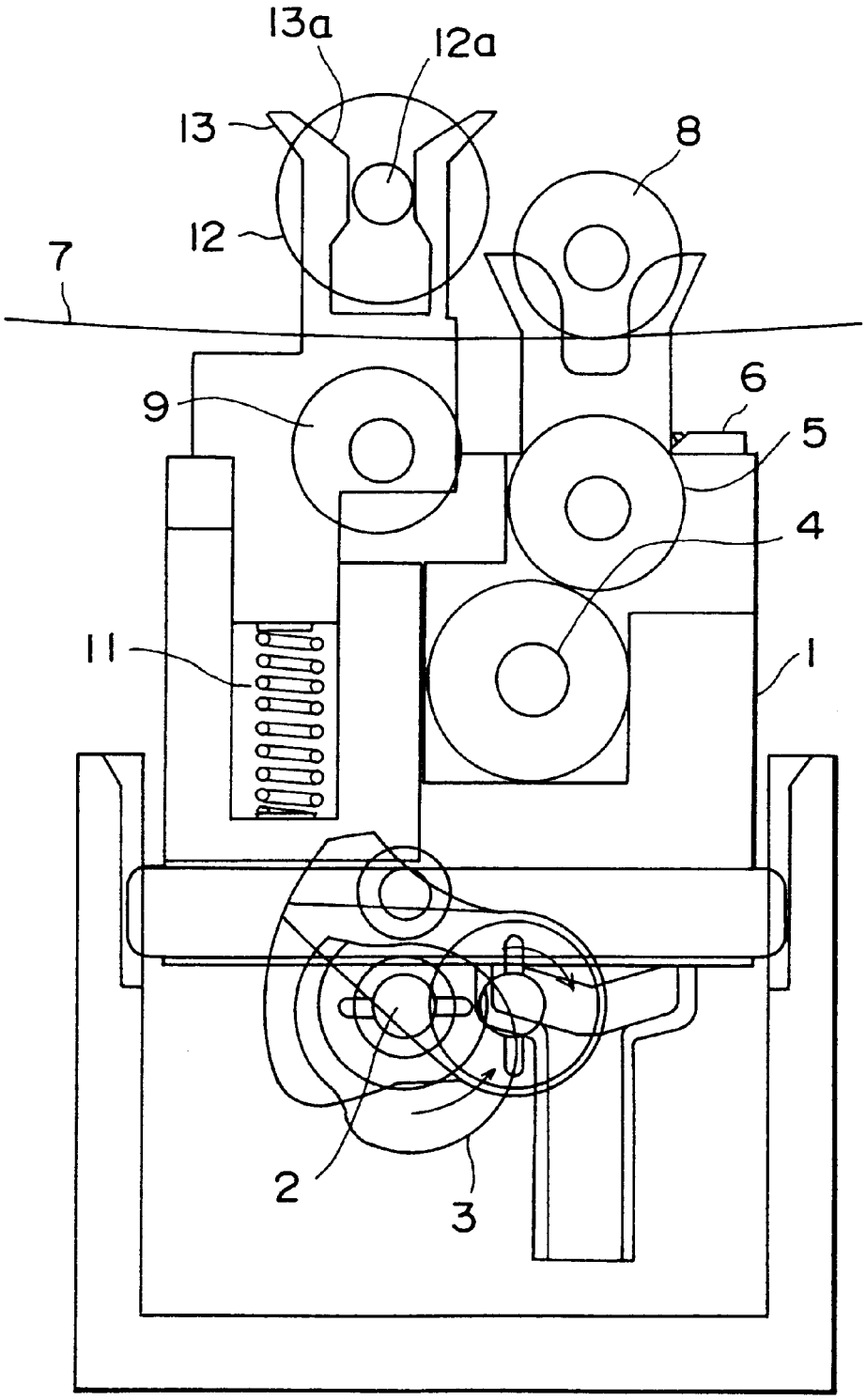
FIG. 3 is a longitudinal sectional view showing the developing unit according to the embodiment of the invention when the development has been completed.

Referring to FIG. 3, after complete reverse squeezing, the developing unit 1 is lowered to the lower stage by the cam 3 of the camshaft 2 rotated by the motor. As a result, the photoconductor belt 7 comes completely out of contact with the developing unit 1.

Figure 4A:
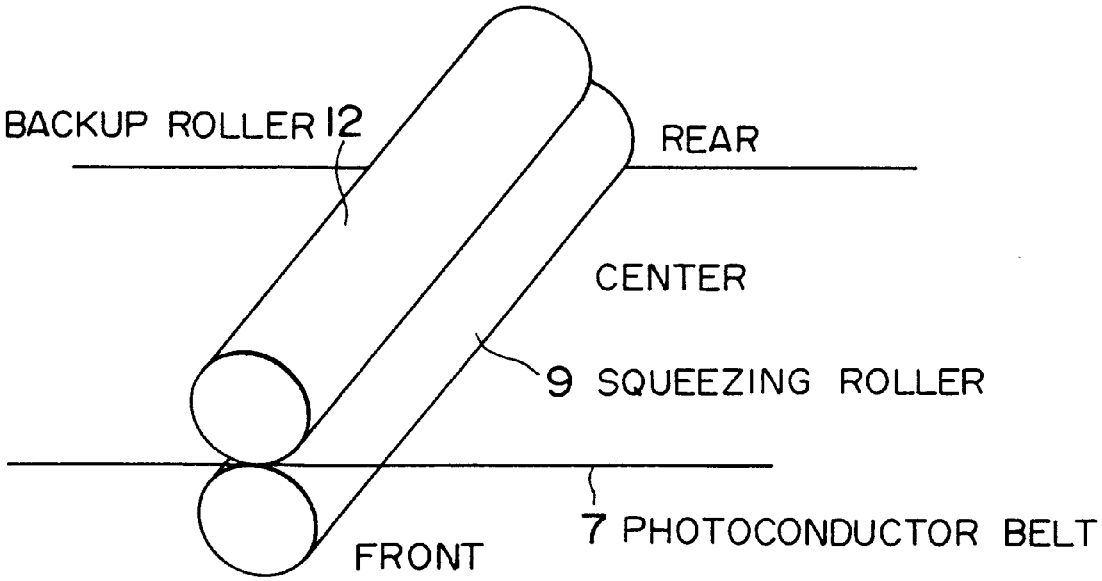
FIG. 4A is a perspective view of the appearance with a backup roller and a squeezing roller arranged in parallel.
Figure 5A:
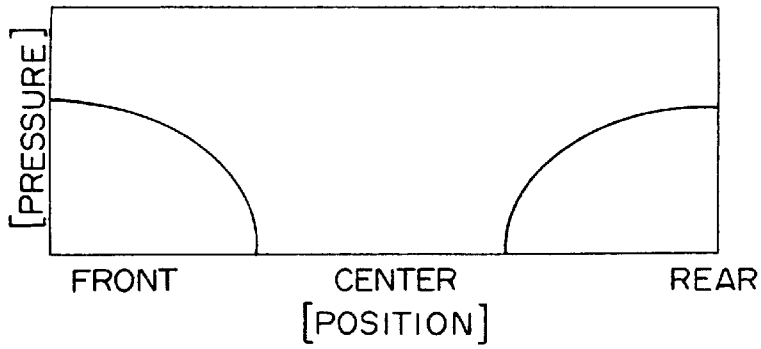
FIG. 5A is a diagram showing the distribution of the holding pressure for development under the condition of FIG. 4A.

In a development process, assuming that the squeezing roller 9 and the squeezing backup roller 12 are completely overlapped with tech other in axially parallel relation as in the prior art (see FIG. 4A). The squeezing force applied by the squeezing roller 9 to the photoconductor belt 7 would be high at the ends and low at the central portion (see FIG. 5A), with the result that the image thickness cannot be reduced uniformly.

Figure 4B:
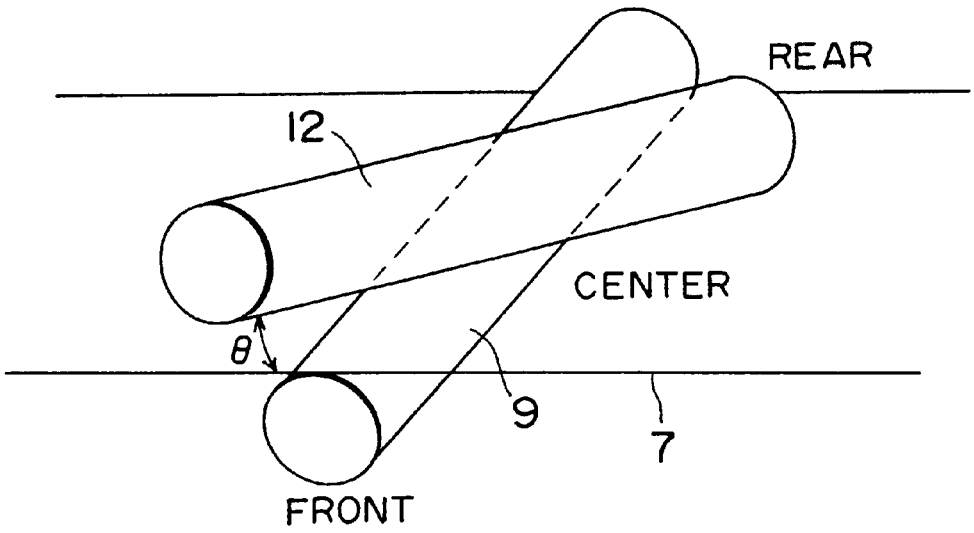
FIG. 4B is a perspective view of the appearance with the backup roller and the squeezing roller crossing each other.

In view of this, according to the embodiment, the squeezing roller 9 and the squeeze backup roller 12 are arranged at a horizontally tilting angle θ (FIG. 4B). Thus, the overlapped portion (central portion) is high in pressure, and the squeezing pressure can be substantially equalized at the ends and the central portion as shown in FIG. 5B.

Figure 5B:
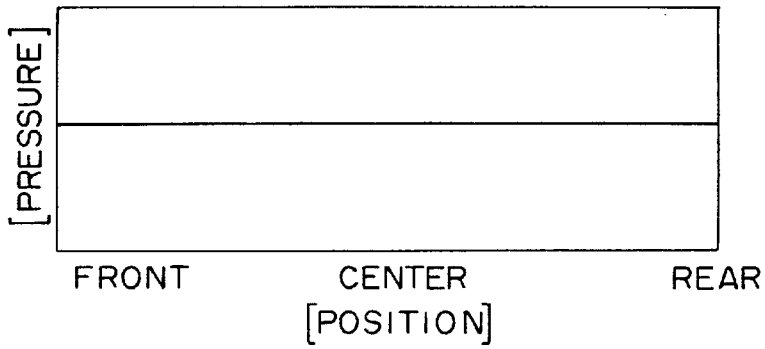
FIG. 5B is a diagram showing the distribution of the holding pressure for development under the condition of FIG. 4B.
Figure 5C:
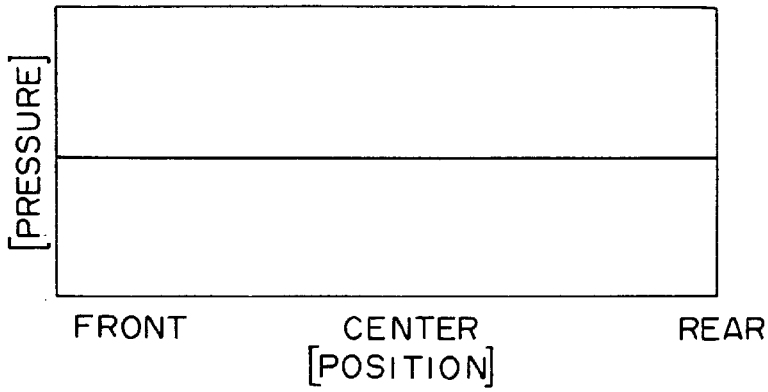
FIG. 5C is a diagram showing the distribution of the holding pressure with the squeeze operation performed in the state of FIG. 4A.

In the reverse squeeze mode, on the other hand, the squeezing roller 9 and the squeeze backup roller 12 are arranged in axially parallel relation (with the tilting angle θ=0) thereby to maintain a uniform contact pressure as shown in FIG. 5C. Specifically, at the time of reverse squeezing when the squeezing roller 9 and the squeeze backup roller 12 are completely overlapped with each other (FIG. 4A), the squeezing pressure exerted on the photoconductor belt 7 by the squeezing roller 9 is substantially uniform as shown in FIG. 5C.

Figure 5D:
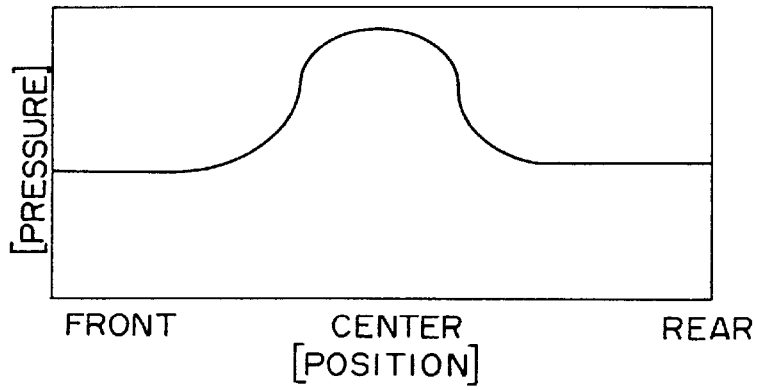
FIG. 5D is a diagram showing the distribution of the holding pressure with the squeeze operation performed in the state of FIG. 4B.

If the squeezing roller 9 and the squeezing backup roller 12 remain axially crossed at the time of reverse squeezing and development, then the pressure at the axial central portion of the roller would increase to such an excessively degree that an imbalance is caused in the axial distribution of the squeeze pressure as shown in FIG. 5D.

The series of operations described above can maintain a uniform distribution of the squeezing pressure not only at the time of squeezing but also at the time of reverse squeezing as shown in FIGS. 5B and 5C.

It will thus be understood from the foregoing description that according to this invention, the squeezing roller and the squeezing backup roller are crossed at an angle to increase the pressure at the central portion thereof at the time of development and squeezing. The tilting angle may be determined so that the squeezing contact pressure at the ends and the central portion of the rollers are substantially equalized, thereby securing a uniform contact pressure along the direction of roller axis.

At the time of reverse squeezing, on the other hand, the squeezing roller 9 and the squeezing backup roller 12 are arranged to a position of zero crossing angle thereby to secure the balance of contact pressure for reverse squeezing.

Consequently, uneven distribution of squeezing contact pressure can be eliminated and a uniform contact pressure can be secured also at the time of development and squeezing, and at the time of reverse squeezing.

What is claimed is:

1. A wet-type image forming apparatus comprising:

a photoconductor belt having a development side and a non-development side thereof;

a first roller provided in the development side of the photoconductor belt, for removing a excess liquid developer from the development side of the photoconductor belt;

a second roller provided in the non-development side of the photoconductor belt, for holding the photoconductor belt with the first roller under a predetermined pressure during development;

a driving mechanism for moving the first roller toward and away from the photoconductor belt; and a tilting mechanism for tilting a longitudinal axis of the second roller to a predetermined angle with respect to a longitudinal axis of the first roller about a longitudinal middle point thereof during the development.

2. A wet-type image forming apparatus according to claim 1, wherein the tilting mechanism sets the longitudinal axis of the second roller in parallel to that of the first roller when a holding force produced by the first roller and the second roller is weakened by the driving mechanism.

3. A wet-type image forming apparatus according to claim 1, wherein the tilting mechanism comprises:

a pair of supporting members for rotatably and slidably supporting the second roller at ends thereof, the supporting members having a pair of cam slits formed therein, respectively, wherein the ends of the second roller are supported by the cam slits, respectively, and are moved in opposite horizontal directions in synchronism with movement of the first roller by the driving mechanism.

4. A wet-type image forming apparatus according to claim 1, further comprising a blade which is provided near the first roller, wherein the blade comes into contact with a surface of the first roller to remove an excess liquid developer from the surface of the first roller when the longitudinal axis of the second roller is set in parallel to that of the first roller.

5. A wet-type image forming apparatus according to claim 1, wherein the first roller is driven in an opposite rotational direction when the longitudinal axis of the second roller has been in parallel to that of the first roller.

6. A wet-type image forming apparatus according to claim 1, wherein the driving mechanism comprises:

a spring for energizing the first roller toward the second roller with a predetermined pressure; and a cam for moving the first roller toward and away from the photoconductor belt.

7. A wet-type image forming apparatus according to claim 6, wherein the spring reduces a contact pressure between the first roller and the second roller when the longitudinal axis of the first roller has been in parallel to that of the second roller.

8. A wet-type image forming apparatus according to claim 6, wherein the cam provides the first roller with at least two stages corresponding to a development operation and a reverse squeezing operation, respectively.

9. A wet-type image forming apparatus according to claim 8, wherein the development operation is performed when the longitudinal axis of the second roller is tilted to a predetermined angle with respect to the longitudinal axis of the first roller and the reverse squeezing operation is performed when the longitudinal axis of the first roller has been in parallel to that of the second roller.

10. A method for removing an excess liquid developer from a surface of a photoconductor belt in a wet-type image forming apparatus including:

a squeezing roller provided in a development side of the photoconductor belt; and a backup roller provided in a non-development side of the photoconductor belt, for holding the photoconductor belt with the squeezing roller under a predetermined pressure, the method comprising the steps of:

during development, a) moving the squeezing roller toward the photoconductor belt to set a first stage; and b) tilting a longitudinal axis of the backup roller to a predetermined angle with respect to a longitudinal axis of the squeezing roller about a longitudinal middle point thereof.

11. A method according to claim 10, further comprising the steps of:

when the development has been completed, c) moving the squeezing roller away from the photoconductor belt by a predetermined distance to set a second stage where a holding force produce by the squeezing roller and the backup roller is reduced; and d) setting the longitudinal axis of the backup roller in parallel to that of the squeezing roller.

12. A method according to claim 11, further comprising the step of:

e) rotating the squeezing roller in an opposite direction to movement of the photoconductor belt to remove an excess liquid developer from the surface of the photoconductor belt.

* * * * *